US005121794A

United States Patent [19]

Hibdon et al.

[11] Patent Number: 5,121,794

[45] Date of Patent: Jun. 16, 1992

[54] WASTE FLUID CONTAINMENT AND RECOVERY APPARATUS

[75] Inventors: Orville C. Hibdon, Ojai; Jimmy D. Norris, Oak View, both of Calif.

[73] Assignee: Autis C. Kanady, Bakersfield, Calif. ; a part interest

[21] Appl. No.: 576,964

[22] Filed: Sep. 4, 1990

[51] Int. Cl.[5] ..... E21B 34/16

[52] U.S. Cl. ..... 166/81

[58] Field of Search ..... 166/75.1, 76, 77.5, 166/81, 82; 175/217, 210, 308, 424, 208, 209

[56] References Cited

U.S. PATENT DOCUMENTS

| | | | |
|---|---|---|---|
| 1,334,678 | 3/1920 | Riley | 166/75.1 |
| 1,418,612 | 6/1922 | Beard | 166/81 |
| 1,448,243 | 3/1923 | Wilson | 166/81 |
| 2,137,832 | 11/1938 | Cordes | 166/81 |
| 3,173,502 | 3/1965 | Overby | 175/210 |
| 3,270,810 | 9/1966 | Johnston | 166/81 X |
| 4,029,160 | 6/1977 | Leidvik | 175/210 |
| 4,665,976 | 5/1987 | Retherford | 166/81 |
| 4,949,784 | 8/1990 | Evans | 166/81 |

*Primary Examiner*—Ramon S. Britts
*Assistant Examiner*—Roger J. Schoeppel
*Attorney, Agent, or Firm*—Donald A. Streck

[57] ABSTRACT

This invention is a waste fluid containment and recovery apparatus for installation on the well-head of an oil well in-line with a pair of interfacing flanges thereof. There is a pan having a bottom and surrounding sidewalls. The bottom has a bore therethrough. There is also a flange interface having a pair of opposed interfacing surfaces which interface with respective ones of the pair of interfacing flanges disposed around the bore for sealably connecting the bottom of the pan in line with the well-head. A drain pipe is connected through the bottom for connection to a hose leading to waste fluid recovery apparatus.

3 Claims, 2 Drawing Sheets

WASTE FLUID CONTAINMENT AND RECOVERY APPARATUS

BACKGROUND OF THE INVENTION

This invention relates to apparatus for containing waste fluid for recovery purposes and, more particularly, to waste fluid containment and recovery apparatus for installation in-line with a piping system at a pair of interfacing flanges thereof comprising, a pan having a bottom and surrounding sidewalls, the bottom having a bore therethrough; and, flange interface means having a pair of opposed interfacing surfaces which interface with respective ones of the pair of interfacing flanges disposed around the bore for sealably connecting the bottom of the pan in line with the piping system.

For a long time, the art of oil well drilling and servicing has operated in a very basic fashion as shown in simplified form in FIG. 1. A pit 10 is typically dug in the ground 12 surrounding the pipe 14 which terminates in a well-head 16. Additional apparatus 18 is then connected to the well-head 16 by means of a connecting flange 18. The pit 10 may be anywhere from a few inches to several feet deep. As waste fluids are produced as part of the drilling and servicing processes, they simply drop by gravity into the pit.

With contemporary concern for contamination problems in the environment, it was quickly realized that the waste fluids entering the pit 10 can seep into the ground water supplies and cause serious contamination problems. Accordingly, governmental regulatory agencies started controlling such processes to assure that contamination does not take place. The use of such pits has been essentially outlawed since any spills of potentially hazardous fluids requires that the soil containing the spill be dug up and be disposed of at a hazardous waste disposal site. This, of course, can be a very costly undertaking. Thus, at this time, oil companies, and the like, who are the most seriously effected by such changes in public policy and regulations, are in a quandary as to how to best proceed with their operations while minimizing the financial impact to them. Of course, simply doing business as usual and absorbing the costs of spills and paying any fines that are levied is not a viable alternative as public outrage at such an attitude would quickly result in appropriate pressures being put on the cognizant regulatory authorities and the blatantly infringing companies would be shut down.

Thus, it is an object of this invention to provide apparatus for catching and containing fluid waste by-products from drilling operations, and the like.

It is another object of this invention to provide apparatus for catching and containing fluid waste by-products in a manner which provides for the easy and inexpensive disposal of such fluids.

It is yet another object of this invention to provide apparatus for catching, containing, and disposing of fluid waste by-products which is simple and effective to use but low in cost to manufacture, install, and operate.

It is still another object of this invention to provide apparatus for catching, containing, and disposing of fluid waste by-products which does not interfere with normal operation of associated waste fluid-producing apparatus.

Other objects and benefits of the invention will become apparent from the detailed description which follows hereafter when taken in conjunction with the drawing figures which accompany it.

SUMMARY

The foregoing objects have been achieved by the waste fluid containment and recovery apparatus of the present invention for installation in-line with a piping system at a connector thereof comprising, a pan having a bottom and surrounding sidewalls, the bottom having a bore therethrough; and, connector interfacing means disposed around the bore for sealably connecting the bottom of the pan in line with the connector.

In the preferred embodiment, the pan bottom has a drain pipe connected through the bottom.

In an alternate configuration for high-pressure installations, the sidewalls have a containment shield extending inward therefrom around a top edge thereof.

In one embodiment, the connector of the piping system comprises a pair of interfacing flanges; and, the connector interfacing means comprises a flange interface having a pair opposed interfacing surfaces which interface with respective ones of the pair of interfacing flanges. In a preferred embodiment thereof, the flange interface has a first inner O-ring groove in a top interfacing surface thereof and an outer O-ring groove and a second inner O-ring groove in a bottom interfacing surface thereof.

DESCRIPTION OF THE DRAWINGS

FIG. 2 is a side view cross section through a catching and containment pan according to the present invention mounted as part of a well-head or the like.

DESCRIPTION OF THE PREFERRED EMBODIMENT

While the description which follows hereinafter is with particular reference to oil field drilling apparatus, those skilled in the art will readily recognize and appreciate that the present invention has uses in other similar applications where an in-line apparatus for catching and containing waste fluids which may be produced for later (or present) disposal is desired or required. Accordingly, it is the inventors' intent that the claims which follow hereafter be accorded a breadth in keeping with the scope and spirit of the invention and that they not be limited because of the use of a particular example for convenience only.

Figure 1:
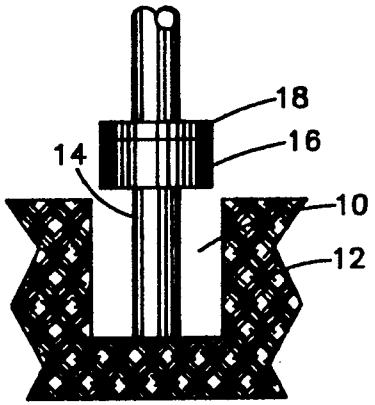
PRIOR ART FIG. 1
FIG. 1 is a simplified partial cross-section through the area surrounding an installation of well-drilling apparatus showing the prior art approach to catching and containing waste fluids.
Figure 2:
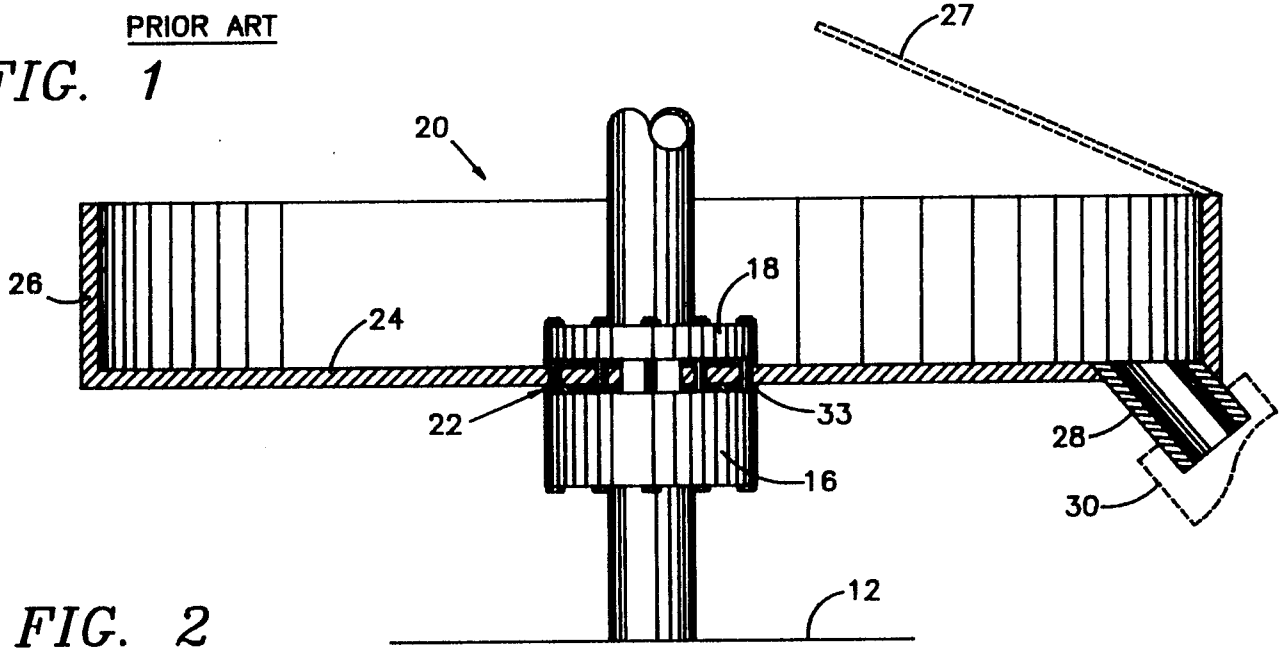

As shown in FIG. 2, the present invention comprises a catching and containment pan 20 which is mounted in-line with the apparatus being protected. That is, to be effective for its intended purpose, the pan 20 must become integral with the protected apparatus and a leak-proof part thereof. In the case of the pan 20 of FIGS. 2 through 5 being described herein for principle use in oil-drilling apparatus, this integral in-line integrity is provided by the inclusion of a flange interface 22 in the bottom 24 of the pan 20. The flange interface 22 is of a type which will mate with the well-head 16 and the connecting flange 18. For piping systems with other types of in-line connectors, the pan 20 will, of course, have to have an appropriate connector interface to replace the flange interface 22.

The pan 20 has surrounding sidewalls 26. It is convenient for manufacture (and for use without corners for personnel to bump into) to make the pan cylindrical in shape; but, it could be other shapes without changing the novelty thereof. If desired and necessary for the particular installation, a containment shield as shown ghosted at 27 can be added to the top of the sidewalls 26. Such a containment shield would be particularly useful in applications where the fluids in the protected apparatus are under high pressure and might spray out from around the connector rather then simply seeping. The bottom 24 can be generally flat, as shown in FIG. 2, or could be domed, for example, being higher at the center so that any fluids will flow to the outer periphery. A drain pipe 28 is preferably connected through the bottom 24 at the periphery thereof so that a hose (shown ghosted as 30) can be attached thereto to safely route the waste fluids entering the pan 20 to appropriate supplemental containment and disposal equipment which forms no part of the present invention per se.

Figure 5:
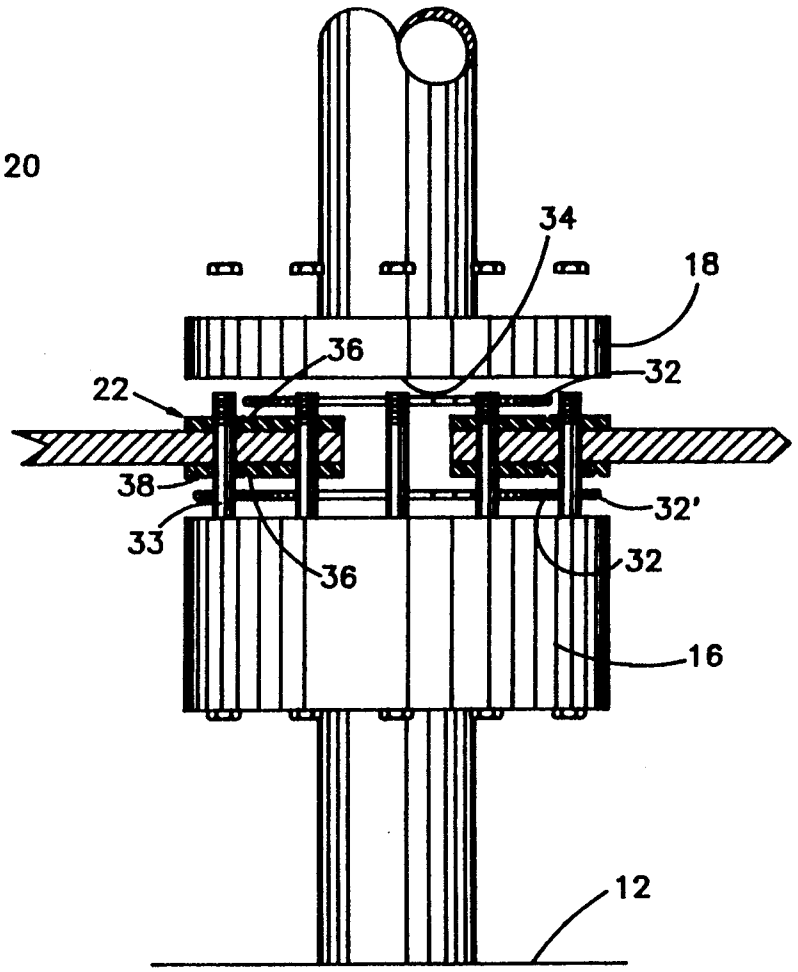
FIG. 5 is an enlarged, exploded view of the apparatus of FIG. 2 showing the preferred placement of O-rings therein.
Figure 3:
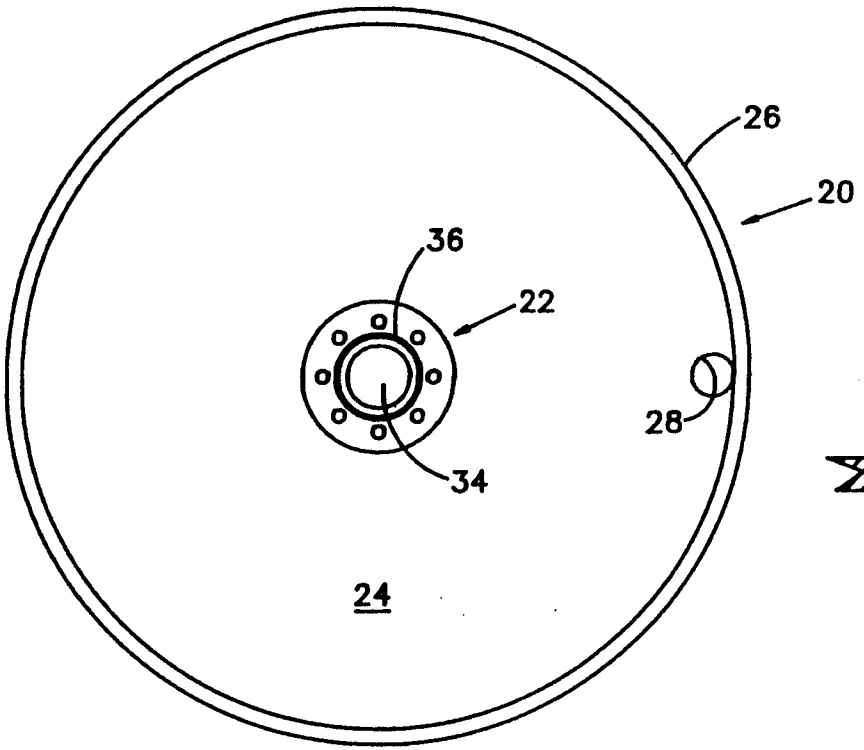
FIG. 3 is a plan view of the catching and containment pan of FIG. 2.
Figure 4:
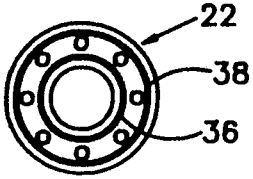
FIG. 4 is a plan view of the bottom flange member of the catching and containment pan of FIGS. 2 and 3.

As best seen from FIGS. 3 through 5, a standard oil-drilling flange typically has a single O-ring 32 within the circle of connecting bolts 33 and the through-bore 34 thereof. In testing the present invention, however, it was found that added security against waste leakage was obtained by adding a second O-ring 32' outside of the circle of connecting bolts 33 on the bottom of the flange interface 22. Such an additional O-ring is, therefore, preferred to assure the desired and required in-line integrity of the pan 20. For this purpose, the flange interface 22 has a single inner O-ring groove 36 in the top face thereof and an outer O-ring groove 38 in addition to an inner O-ring groove 36 in the bottom face thereof.

Thus, it can be seen from the foregoing description and the drawing figures which accompany it that the present invention has truly met its stated objectives by providing simple and easy to use apparatus for catching and containing waste fluids so that they may be disposed of simply and inexpensively and thereby prevent costly spills of waste materials into the environment.

Wherefore, having thus described our invention, we claim:

1. Waste fluid containment and recovery apparatus for installation on the well-head of an oil well in-line with a pair of interfacing flanges thereof comprising:

a) a pan having a bottom and surrounding sidewalls, said bottom having a bore therethrough;

b) flange interface means having a pair of opposed interfacing surfaces which interface with respective ones of the pair of interfacing flanges disposed around said bore for sealably connecting said bottom of said pan in line with the well-head; and, c) drain pipe means connected through said bottom for connection to a hose leading to waste fluid recovery apparatus.

2. The waste fluid containment and recovery apparatus of claim 1 wherein:

said sidewalls have a containment shield extending inward therefrom around a top edge thereof.

3. The waste fluid containment and recovery apparatus of claim 1 wherein:

said flange interface means has a first inner O-ring groove in a top interfacing surface thereof and an outer O-ring groove and a second inner O-ring groove in a bottom interfacing surface thereof.

* * * * *